US007055945B2

(12) United States Patent
Yoneyama et al.

(10) Patent No.: US 7,055,945 B2
(45) Date of Patent: Jun. 6, 2006

(54) INK JET PRINTER AND INK JET RECORDING METHOD

(75) Inventors: Tsutomu Yoneyama, Hachioji (JP); Koji Matsushima, Hachioji (JP)

(73) Assignee: Konica Minolta Holdings, Inc. (JP)

( * ) Notice: Subject to any disclaimer, the term of this patent is extended or adjusted under 35 U.S.C. 154(b) by 324 days.

(21) Appl. No.: 10/723,057

(22) Filed: Nov. 25, 2003

(65) Prior Publication Data

US 2004/0119802 A1 Jun. 24, 2004

(30) Foreign Application Priority Data

Nov. 27, 2002 (JP) ..... 2002-343548
Nov. 5, 2003 (JP) ..... 2003-375638

(51) Int. Cl.
*B41J 2/01* (2006.01)
*B41J 23/00* (2006.01)

(52) U.S. Cl. ..... 347/102; 347/37

(58) Field of Classification Search ..... None
See application file for complete search history.

(56) References Cited

U.S. PATENT DOCUMENTS 6,454,405 B1 9/2002 Stowe
6,520,623 B1 * 2/2003 Miyake et al. ..... 347/40
6,966,645 B1 * 11/2005 Takabayashi ..... 347/100
2001/0052920 A1 12/2001 Matsumoto et al.
2002/0122106 A1 9/2002 Ylitalo

FOREIGN PATENT DOCUMENTS

JP 20011310454 6/2001

OTHER PUBLICATIONS

European Search Report, Application No. EP 03 25 7385, Dated Mar. 24, 2004.

* cited by examiner

*Primary Examiner*—Thinh Nguyen
(74) *Attorney, Agent, or Firm*—Cantor Colburn LLP

(57) ABSTRACT

An ink jet printer having: a recording head for jetting an active energy ray curable ink on a recording medium, wherein the ink is jetted to the recording medium while carrying out a scanning the recording head and the recording medium relatively scanned; an active energy ray irradiation device for irradiating the recording medium on which the ink was jetted with an active energy ray to cure the ink jetted; a detection mechanism for detecting a scanning condition of at least one of the recording head and the recording medium; and a control section for stopping the active energy ray irradiation by the active energy ray irradiation device when the control section judges from a detected result by the detection mechanism that scanning the recording head and the recording medium relatively is not carried out normally.

20 Claims, 8 Drawing Sheets

INK JET PRINTER AND INK JET RECORDING METHOD

BACKGROUND OF THE INVENTION

1. Field of the Invention

The present invention relates to an ink jet printer and an ink jet recording method, particularly to an ink jet printer and an ink jet recording method in which ultraviolet curable ink is used.

2. Description of the Related Art

As an image recording method, there has been an ink jet printer, in which ink is jetted from a recording head to a recording medium which is carried to carry out image recording.

There are serial type and line type ink jet printers. In the serial print type, a recording head is mounted on a carriage which reciprocates along a guide rail which is disposed in a direction perpendicular to a carrying direction of the recording medium, and recording is carried out while reciprocating the recording head along the guide rail. In the line head type, a recording head which is formed to have a recording range width for the recording medium is disposed in a direction perpendicular to a carrying direction of the recording medium, and recording is carried out line by line.

A recording head of the ink jet printer which is used in each type has a jet surface which faces the recording medium, and jet openings are formed on the jet surface for jetting ink.

The jet surface is in proximity to the recording medium to be carried, so that when jamming of the recording medium or the like occurs for any reason, the jet surface may contact with the recording medium and the recording head may be damaged. Thus, when such abnormality occurs in the ink jet printer, the ink jet printer stops scanning the recording head and the recording medium relatively to each other.

Recently, an ink jet printer in which ultraviolet (UV) curable ink which is cured by the UV irradiation has been used, in which an UV-rays irradiation device for irradiating the recording medium with UV-rays is provided.

However, after jetting and placing the UV curable ink onto the recording medium, when it takes a long time to irradiate with UV-rays and cure the UV curable ink, the UV curable ink may blot or change in color on the recording medium depending upon a recording environment, jetting condition of the UV curable ink or the like. Thus, in the earlier developed ink jet printer in which the UV curable ink is used, the UV irradiation device is disposed adjacent to the recording head, so that the ink is irradiated with UV-rays immediately after placing the ink to cure the ink (see, for example, Japanese Application Patent Laid-Open Publication No. 2001-310454 (p.3, FIG. 1)).

In the earlier developed ink jet printer, when abnormality such as jamming or the like occurs, even if the ink jet printer stops or stopped scanning the recording head and the recording medium relatively to each other, a light source of the UV irradiation device is kept on. Accordingly, for example, when jamming or the like occurs and the recording medium is undulated or folded, UV-rays are reflected diffusely from an irregular surface of the recording medium and the jet surface of the recording head is irradiated.

The UV-rays which are reflected diffusely and are radiated to the jet surface have intensity about three times of its normal intensity. When such the light is radiated to the jet surface, there is a problem that the ink on the jet surface and the jet opening is cured.

SUMMARY OF THE INVENTION

The present invention is developed in view of the above described points, and an object of the present invention is to provide an ink jet printer which can prevent ink on a surface of a recording head from curing even when abnormality occurs in the ink jet printer.

In the first aspect of the invention, the ink jet printer comprises:

a recording head for jetting an active energy ray curable ink on a recording medium, wherein the ink is jetted to the recording medium while carrying out a scanning the recording head and the recording medium relatively scanned;

an active energy ray irradiation device for irradiating the recording medium on which the ink was jetted with an active energy ray to cure the ink jetted;

a detection mechanism for detecting a scanning condition of at least one of the recording head and the recording medium; and a control section for stopping the active energy ray irradiation by the active energy ray irradiation device when the control section judges from a detected result by the detection mechanism that scanning the recording head and the recording medium relatively is not carried out normally.

Accordingly, the scanning condition of at least one of the recording head and the recording medium is detected by the detection mechanism, and the control section judges whether the scanning is carried out normally. When the control section judges that abnormality occurred, the control section stops the active energy ray irradiation by the active energy ray irradiation device.

According to the ink jet printer, the surface of the recording head is not irradiated with the active energy rays when abnormality occurred in the ink jet printer, so that it is prevented that the active energy ray curable ink which adheres to the jet surface of the recording head is cured.

Preferably, the active energy ray irradiation device is positioned on a downstream side of a position recorded by the recording head in a direction of the scanning.

Preferably, the control section stops the scanning when the control section judges from the detected result by the detection mechanism that the scanning is not carried out normally.

The ink jet printer may further comprise a carriage for mounting the recording head, a driving motor for moving the carriage, and a carrying mechanism for carrying the recording medium, wherein the recording head may be a serial print type, and the scanning may be carried out by reciprocally moving the carriage in a direction perpendicular to a carrying direction of the recording medium.

According to the ink jet printer, the detection mechanism detects the condition of the scanning carried out in the serial print type, and the control section judges whether the scanning is carried out normally. When the control section judges that abnormality occurs in the scanning, the control section stops the active energy ray irradiation by the active energy ray irradiation device.

Accordingly, the surface of the recording head is not irradiated with active energy rays when abnormality occurs in the ink jet printer of the serial print type. Thus, the serial print type ink jet printer in which the active energy ray curable ink which adheres to the jet surface of the recording head is not cured can be realized.

The recording head may be a line print type, and the scanning may be carried out by carrying the recording medium relative to the recording head.

According to the ink jet printer, the detection mechanism detects the condition of the scanning carried out in the line print type, and the control section judges whether the scanning is carried out normally. When the control section judges that abnormality occurs in the scanning, the control section stops the active energy ray irradiation by the active energy ray irradiation device.

Accordingly, the surface of the recording head is not irradiated with active energy rays when abnormality occurs in the ink jet printer of the line print type. Thus, the line print type ink jet printer in which the active energy ray curable ink which adheres to the jet surface of the recording head is not cured can be realized.

Preferably, a light receiving sensor for detecting an active energy ray is provided as the detection mechanism on a surface of the recording head in which jet openings for jetting the ink are formed, and the control section judges that the scanning is not carried out normally when the light receiving sensor detects an active energy ray which is not less than a predetermined value.

A motor encoder for generating a pulse signal to detect a rotation amount of the driving motor may be provided as the detection mechanism, and the control section may judge that the scanning is not carried out normally when the motor encoder does not output a pulse signal normally.

A linear encoder for generating a pulse signal by being synchronized with a movement of the carriage may be provided as the detection mechanism, and the control section may judge that the scanning is not carried out normally when the linear encoder does not output a pulse signal normally.

A read sensor for reading a marker attached to the recording medium to generate a signal may be provided as the detection mechanism, and the control section may judge that the scanning is not carried out normally when the read sensor does not output a signal normally.

A tension sensor for detecting a tension which acts on the recording medium to be carried may be provided as the detection mechanism, and the control section may judge that the scanning is not carried out normally when the tension sensor detects a tension which is not less than a predetermined value.

Preferably, the control section stops the active energy ray irradiation by emitting a control signal to the active energy ray irradiation device when the control section judges that the scanning is not carried out normally.

Preferably, the control section stops the scanning by emitting a control signal to the driving motor and the carrying mechanism when the control section judges that the scanning is not carried out normally.

Preferably, the carriage is provided to be movable up and down relative to the recording medium, and the control section moves up the carriage and removes the carriage from a recording region after stopping the scanning.

Preferably, the active energy ray curable ink comprises an ultraviolet curable ink which contains a polymerizable composition.

Preferably, the ultraviolet curable ink comprises a cationic polymerization ink.

The ultraviolet curable ink may comprise a radical polymerization ink.

A plurality of recording heads may be provided to jet same color of ink from more than one recording heads.

In the second aspect of the invention, the ink jet recording method comprises the steps of:

jetting an active energy ray curable ink on a recording medium by a recording head while scanning the recording head and the recording medium relatively;

irradiating the recording medium on which the ink was jetted with an active energy ray by an active energy ray irradiation device to cure the ink;

detecting a scanning condition of at least one of the recording head and the recording medium;

judging from a detected result whether the scanning is carried out normally; and stopping the irradiation with an active energy ray by the active energy ray irradiation device when the scanning is judged not to be carried out normally.

Preferably, in the ink jet recording method, the active energy ray irradiation device is positioned on a downstream side of a position recorded by the recording head in a direction of the scanning.

Preferably, the ink jet recording method further comprises a step of stopping the scanning when the scanning is judged not to be carried out normally.

BRIEF DESCRIPTION OF THE DRAWINGS

The present invention will become more fully understood from the detailed description given hereinafter and the accompanying drawings which are given by way of illustration only, and thus are not intended as a definition of the limits of the present invention, and wherein.

DETAILED DESCRIPTION OF THE PREFERRED EMBODIMENTS

Hereinafter, the preferred embodiments of the present invention will be described in detail by reference to the attached drawings.

[First Embodiment]

The first embodiment of the present invention will be explained referring to FIGS. 1–4.

A structure of an ink jet printer according to the present invention will be explained referring to FIGS. 1–3.

Figure 1:
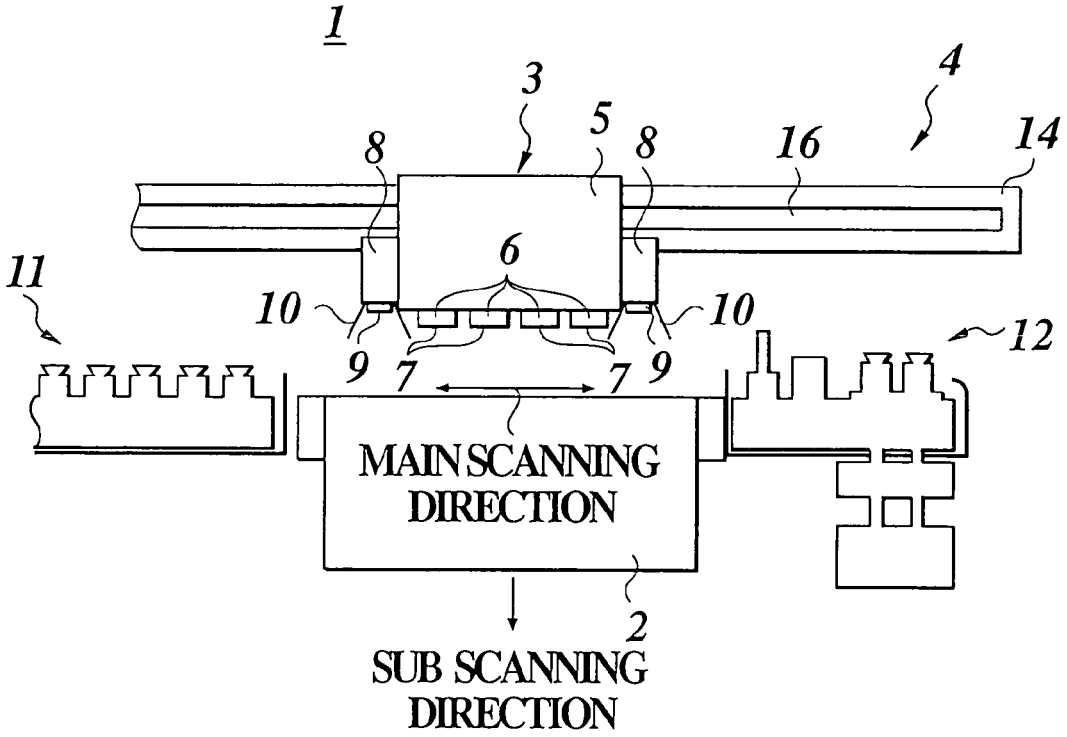
FIG. 1 is a side view showing an embodiment of an ink jet printer of serial print type according to the present invention.

FIG. 1 is a side view of the ink jet printer of serial print type in which ultraviolet (UV) curable ink is used.

The ink jet printer 1 comprises a recording section 3 for jetting ink to a recording medium 2 to carry out image recording, and a guide section 4 for reciprocating the recording section 3 in a main scanning direction which is perpendicular to a sub scanning direction in which the recording medium 2 is carried.

The recording section 3 comprises a carriage 5 on which a plurality of recording heads 6 is mounted.

In the embodiment, there are four recording heads 6 mounted on the carriage 5 for jetting a plurality of colors of ink such as yellow, magenta, cyan and black. On each of the recording heads 6, jet openings (not shown) for jetting ink are formed in a jet surface 7 which faces the recording medium 2. The ink supplied to the recording heads 6 from an ink cartridge (not shown) is filled in nozzles (not shown) for jetting ink from the jet openings and jetted on the recording medium 2 according to need.

UV irradiation devices 8 are attached to the carriage 5 as an active energy ray irradiation device, which irradiate the surface of the recording medium 2 to which the ink jetted from the recording head 6 is attached with UV-rays to cure and fix the ink to the recording medium 2. The UV irradiation devices 8 are provided on both sides of the carriage 5 in the main scanning direction relative to the recording head 6 which is disposed on the carriage 5. An irradiation surface 9 for radiating UV-rays is provided to be opposed to the recording medium 2 as with the jet surface 7. The irradiation surface 9 is provided with a masking blade 10 which regulates an UV irradiation direction to prevent the ink on the jet surface 7 and the jet openings of the recording head 6 from curing by UV-rays radiated from the UV irradiation device 8.

In the present invention, the UV irradiation device 8 is provided as an active energy ray irradiation device, however, it is not limited thereto. For example, an irradiation device which irradiates with light other than UV-rays such as infrared rays, visible rays and the like may be used. That is, the active energy ray in the present invention includes an electron beam or the like as well as electromagnetic waves including light in a broad sense such as a visible ray, a UV-ray, an infrared ray, and an X-ray.

Figure 2:
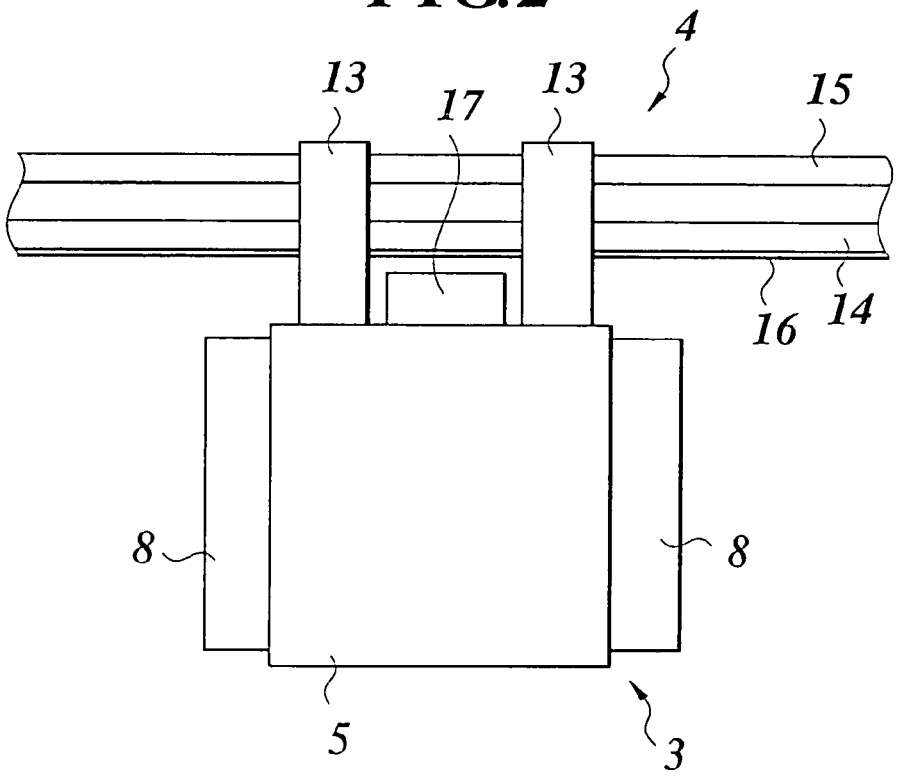
FIG. 2 is a top view of the ink jet printer shown in FIG. 1.

A connecting section 13 connects the carriage 5 and the guide section 4 as shown in FIG. 2.

The guide section 4 comprises a support stage 14 for supporting the connecting section 13 to make the carriage 5 reciprocally movable and a driving belt 15 for reciprocally moving the carriage 5.

A film 16 with striped pattern is provided along the support stage 14, and the carriage 5 is provided with a linear encoder 17 as a detecting mechanism which detects the striped pattern of the film 16 for generating pulse signals. The linear encoder 17 is synchronized with the movement of the carriage 5 to generate pulse signals.

The carriage 5 is reciprocally movable along the guide section 4, and can move to a home position region in which a moisture retaining unit 11 for retaining moisture of the recording head 6 is disposed, a recording region in which ink is jetted on the recording medium 2 and a head maintenance region in which a maintenance unit 12 to reduce nozzle clogging of the recording head 6 is disposed. When image recording is not performed, the carriage 5 is disposed in the home position.

In the embodiment, the recording head 6 is scanned by the carriage 5 in the main scanning direction relative to the recording medium 2, enabling the recording head 6 and the recording medium 2 to scan relatively to each other.

Figure 3:
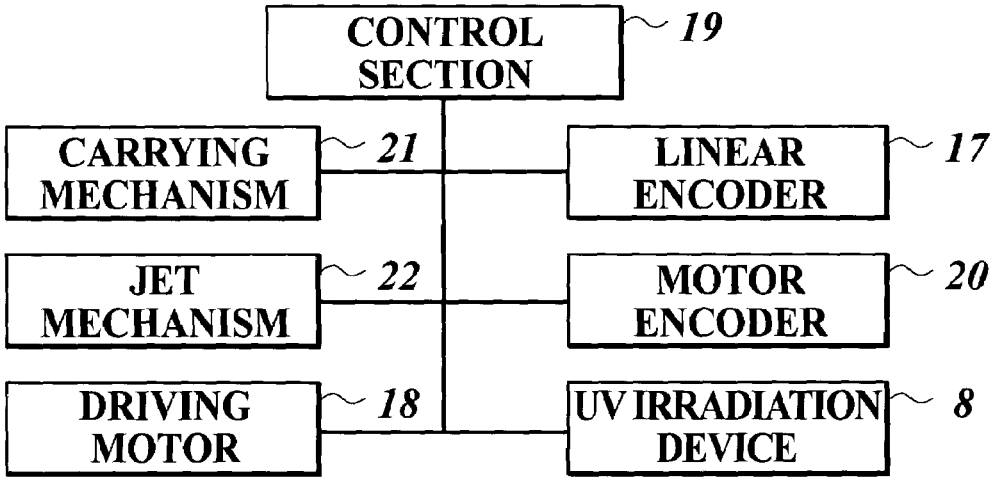
FIG. 3 is a block diagram showing a structure of the ink jet printer shown in FIG. 1.

As shown in FIG. 3, a driving motor 18 for driving the driving belt 15 is controlled by a control section 19. The driving motor 18 is provided with a motor encoder 20 as a detecting mechanism for generating pulse signals to detect the rotation amount of the driving motor 18.

The control section 19 is connected to the driving motor 18, a carrying mechanism 21 for carrying the recording medium 2 in a sub scanning direction, a jet mechanism 22 for jetting ink from the recording head 6 and the UV irradiation device 8, and emits control signals to each of them to control an image recording processing of the ink jet printer 1.

The linear encoder 17 and the motor encoder 20 are electrically connected to the control section 19, and the pulse signals emitted therefrom are transmitted to the control section 19.

The control section 19 synchronizes the pulse signals transmitted from the linear encoder 17 and the motor encoder 20 to compare them. When the operation of the carriage 5 and the driving motor 18 are not normal, the control section 19 judges that abnormality occurred in the ink jet printer 1. When the control section 19 judges that abnormality occurred in the ink jet printer 1, the control section 19 emits control signals to the driving motor 18, the carrying mechanism 21 and the jet mechanism 22 to stop the movement of the recording head 6 and the carrying of the recording medium 2. Moreover, the control section 19 emits a control signal to the UV irradiation device 8 to stop UV irradiation.

The UV curable ink contains a polymerizable composition to cause polymerization reaction so as to be cured by UV irradiation from the UV irradiation device 8. The polymerizable composition is a material which is polymerized and forms polymers by UV irradiation to cure the UV curable ink. As the polymerizable composition, a photo-radical polymerizable composition which is polymerized by radical reaction when light irradiation is performed and a cationic polymerizable composition of a cationic polymerization system which is polymerized by cationic chemical species which acts as a reaction radical species are well known. In the embodiment, any of the UV curable inks of the radical polymerization ink and the cationic polymerization ink which are composed to contain these polymerizable compositions may be used.

An operation of the embodiment will be explained referring to FIG. 4.

Figure 4:
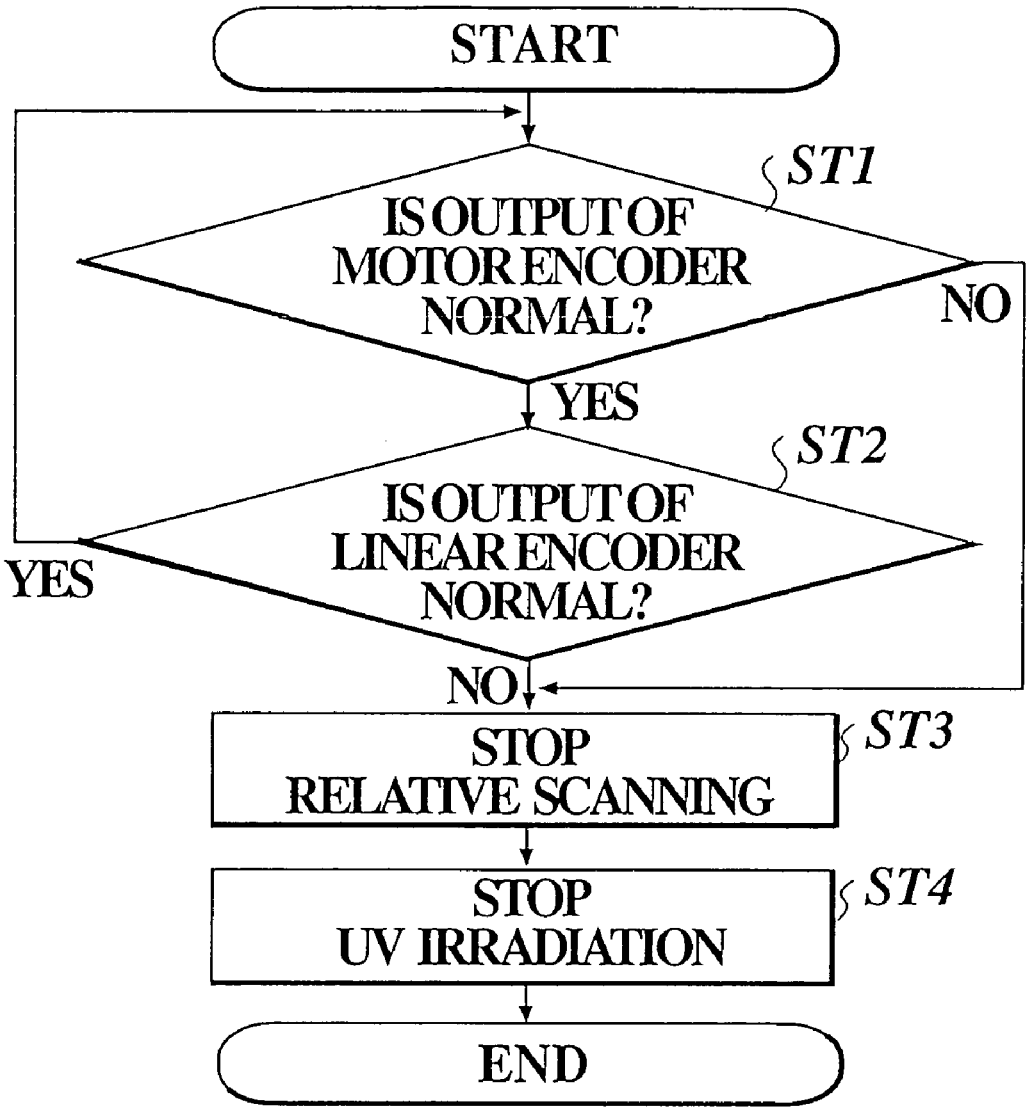
FIG. 4 is a flow chart showing a control performed by the ink jet printer shown in FIG. 1 when abnormality occurs.

FIG. 4 is a flow chart showing a control performed by the ink jet printer when abnormality occurs.

The ink jet printer 1 carries the recording medium 2 after receiving an image forming processing order. The driving motor 18 rotates to reciprocate the carriage 5 along the guide section 4 and move the recording head 6 to a predetermined position for jetting ink on the recording medium 2. The control section 19 recognizes the rotation amount of the driving motor 18 and the position of the carriage 5 by the pulse signals output from the motor encoder 20 and the linear encoder 17.

The recording head 6 mounted on the carriage 5 is scanned while jetting ink at a predetermined position. When pulse signals are output from each of the motor encoder 20 and the linear encoder 17 at a regular interval (Step ST1; YES, Step ST2; YES), the control section 19 judges that the scanning is carried out normally.

When pulse signals are not output from the motor encoder 20 normally (Step ST1; NO), the control section 19 judges that abnormality occurred in the ink jet printer 1.

The control section 19 which judges that abnormality occurred in the ink jet printer 1 emits control signals to the driving motor 18, the jet mechanism 22 and the carrying mechanism 21 to stop the movement of the recording head 6 and the carrying of the recording medium 2 (Step ST3). Moreover, the control section 19 emits a control signal to the UV irradiation device 8 to stop UV irradiation (Step ST4).

Even in case that pulse signals are normally output from the motor encoder 20 (Step ST1; YES), when jamming of the recording medium 2 which is carried or the like occurs, irregular force acts on the carriage 5 which mounts the recording head 6, and the carriage 5 becomes unmovable at a regular speed in Y direction. Therefore, the linear encoder 17 cannot output pulse signals normally (Step ST2; NO), and in this case, the control section 19 judges that abnormality occurred in the ink jet printer 1.

The control section 19 which judges that abnormality occurred in the ink jet printer 1 emits control signals to the driving motor 18, the jet mechanism 22 and the carrying mechanism 21 to stop the movement of the recording head 6 and the carrying of the recording medium 2 (Step ST3). Moreover, the control section 19 emits a control signal to the UV irradiation device 8 to stop the UV irradiation (Step ST4).

A mechanism for moving up the carriage 5 may be provided on the ink jet printer 1. In this case, after the above described control, the space between the recording head 6 and the recording medium 2 becomes wide, so that the recording head 6 whose main scanning was stopped is moved to the home position region without contacting with the recording medium 2.

In the embodiment, both of the motor encoder 20 and the linear encoder 17 are provided as a detecting mechanism, however, any one of them may be provided.

Accordingly, in the embodiment, when the control section 19 detects the operation of the carriage 5 which mounts the recording head 6 and the driving motor 18 by the linear encoder 17 and the motor encoder 20, and judges that abnormality occurred in the ink jet printer 1, the control section 19 stops the UV irradiation by the UV irradiation device 8 as well as the movement of the recording head 6 and the carrying of the recording medium 2. Thus, even when abnormality of the driving motor 18, jamming of the recording medium 2 or the like occurs in the ink jet printer 1, UV-rays are not radiated on the surface of the recording head 6. Therefore, the UV curable ink which attaches to the jet surface 7 of the recording head 6 can be prevented from curing.

[Second Embodiment]

Figure 5:
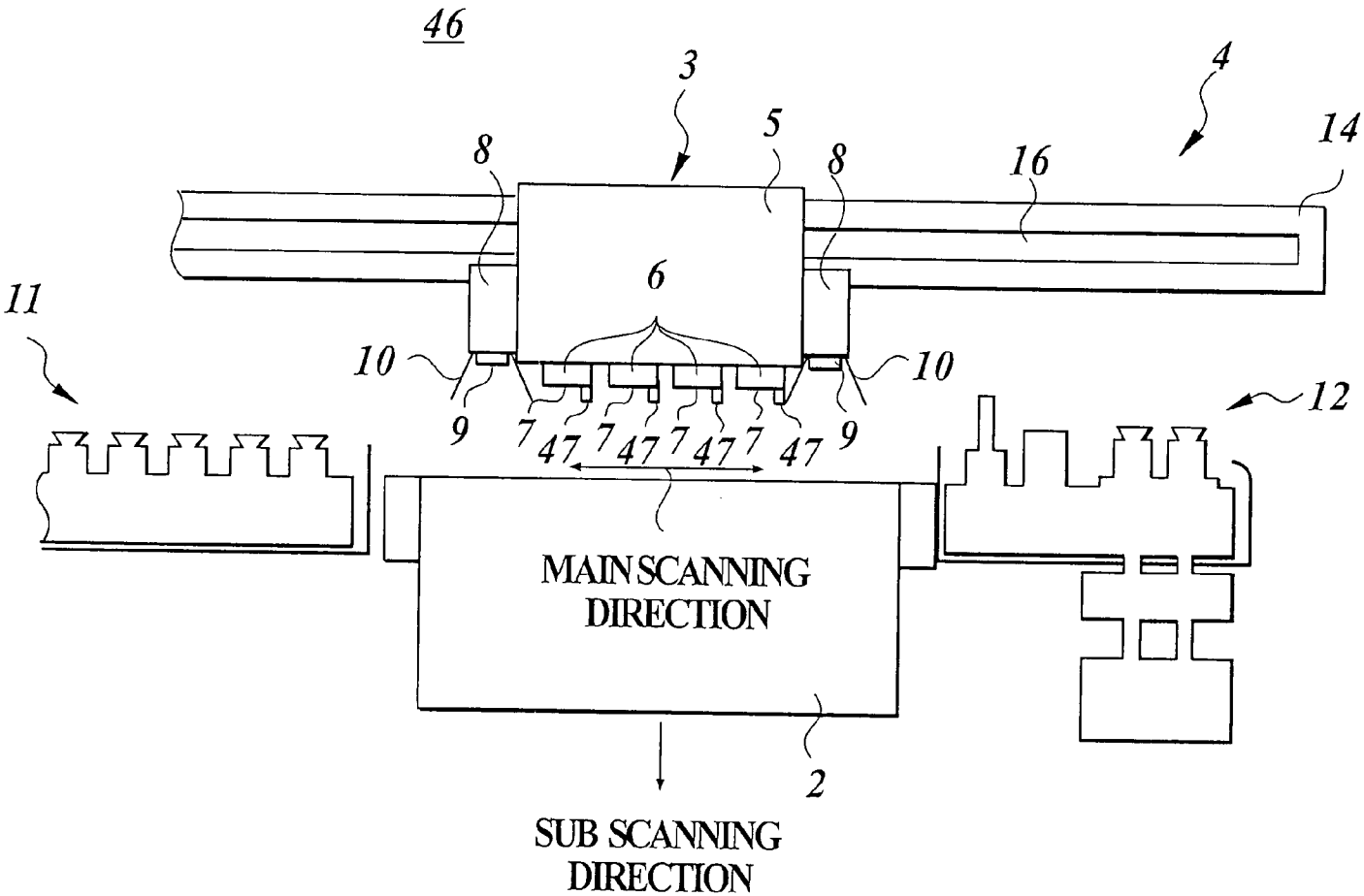
FIG. 5 is a side view showing another embodiment of the ink jet printer of serial print type according to the present invention.

The second embodiment of the present invention will be explained referring to FIG. 5. In an ink jet printer 46 in the embodiment, a structure is same as that in the first embodiment except that a light receiving sensor 47 is provided as the detection mechanism instead of the linear encoder 17 and the motor encoder 20. Specially, the structure which is different from the first embodiment will be explained below.

The ink jet printer 46 comprises the recording head 6 which is mounted on the carriage 5 and jets each color of inks, and the light receiving sensor 47 which detects the ultraviolet-rays (UV-rays) is provided as the detection mechanism on the jet surface 7 of the recording head 6.

The light receiving sensor 47 is connected to the control section 19. When the light receiving sensor 47 detects that the jet surface 7 was irradiated with a great deal of light, the control section 19 stops the carrying of the recording medium 2 by the carrying mechanism 21, the scanning of the carriage 5 by the driving motor 18, the ink jetting by the ink jet mechanism 22 and the UV irradiation by the UV irradiation device 8.

An operation in the embodiment will be explained. When the recording medium 2 is undulated or folded because of jamming or the like, UV-rays are reflected diffusely from the irregular surface of the recording medium 2 to be radiated to the jet surface 7 of the recording head 6. When the light receiving sensor 47 detects the amount of UV-rays not less than the predetermined value, the control section 19 stops the carrying mechanism 21, the driving motor 18, the jet mechanism 22 and the UV irradiation device 8 to stop the image recording operation and the UV irradiation.

Accordingly, the UV irradiation is stopped when jamming of the recording medium 2 or the like occurred in the ink jet printer 46, so that the UV curable ink which attaches to the jet surface 7 of the recording head 6 can be prevented from curing.

[Third Embodiment]

The third embodiment of the present invention will be explained referring to FIGS. 6–8.

A structure of an ink jet printer according to the present invention will be explained referring to FIGS. 6–7.

Figure 6:
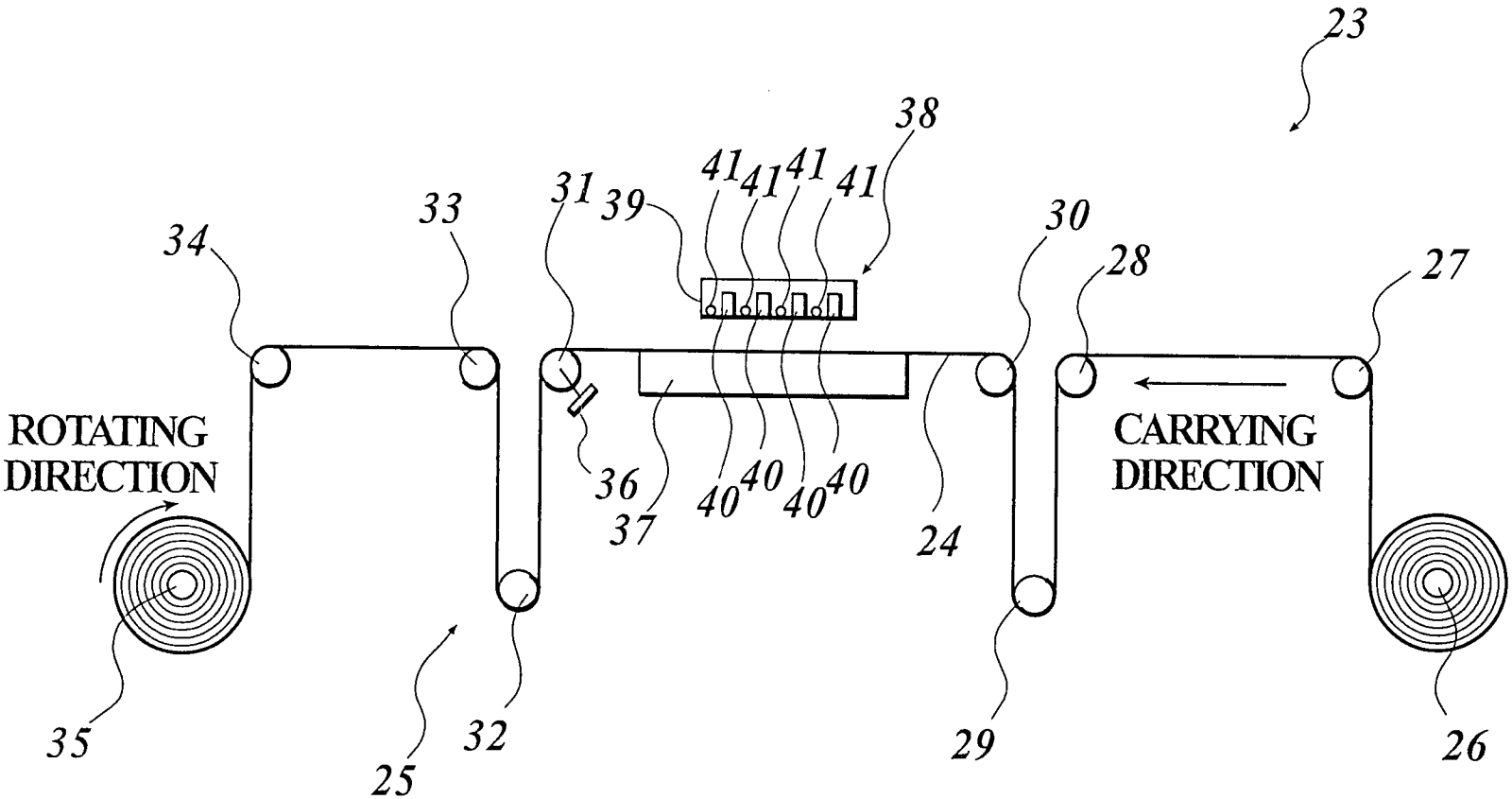
FIG. 6 is a side view showing an embodiment of an ink jet printer of line print type according to the present invention.

FIG. 6 shows the ink jet printer of line print type in which image recording is performed by using the ultraviolet (UV) curable ink on a web-like recording medium 2.

An ink jet printer 23 comprises a carrying mechanism 25 for carrying a recording medium 24 in a carrying direction. The carrying mechanism 25 comprises a feed roller 26 as a supply source of the recording medium 24, driven rollers 27–34 for carrying the recording medium 24 and a winding roller 35 for winding the recording medium 24 on which an image recording was performed, which are disposed in parallel relation each other.

The feed roller 26 is rotatably supported around the shaft, and the recording medium 24 is pre-rolled on the feed roller 26. The winding roller 35 is also rotatably supported around the shaft and is provided with a motor (not shown) for winding the recording medium 24 from the feed roller 26 by rotating the winding roller 35 to carry the recording medium 24. The driven rollers 27–34 are disposed on a carrying path between the feed roller 26 and the winding roller 35, and are rotatably supported around each shaft.

The driven rollers 27, 28, 30, 31, 33, 34 are disposed on the same plane and arranged in the order of the driven rollers 27, 28, 30, 31, 33, 34 from upstream (feed roller 26) side in the carrying direction of the recording medium 24. The feed roller 26, the driven rollers 29, 32 and the driving roller 35 are disposed on the same plane under the driven roller 27 and arranged in the order of the feed roller 26, the driven roller 29, the driven roller 32 and the driving roller 35 from the upstream side in the carrying direction of the recording medium 24.

A tension sensor 36 is attached to the driven roller 31 as the detection mechanism for detecting tension on the recording medium 24. The tension sensor 36, for example, is a load cell, which detects reaction force which acts on the driven roller 31 from the recording medium 24 to detect the tension on the recording medium 24.

A platen 37 is disposed between the driven roller 30 and the driven roller 31 so as to be in parallel with a line which connects the driven roller 30 and the driven roller 31. The platen 37 keeps the recording medium 24 which is carried from the driven roller 30 to the driven roller 31 in almost flat shape. The recording medium 24 is carried so as to abut on the top surface of the platen 37.

The recording section 38 is disposed above the recording medium 24 which is tensioned between the driven roller 30 and the driven roller 31 so as to oppose to the platen 37.

The recording section 38 comprises a supporter 39 which is provided with a plurality of recording heads 40 of line print type for jetting ink on the recording medium 24 and a plurality of UV irradiation devices 41.

The recording head 40 is disposed to extend in a direction perpendicular to the direction in which the recording medium 24 is carried from the driven roller 30 to the driven roller 31, that is, a width direction of the recording medium 24. The bottom surface of the recording head 40 faces the recording medium 24 tensioned between the driven roller 30 and the driven roller 31 and the platen 37, and are provided with a plurality of jet openings (not shown) which form a line in the width direction of the recording medium 24.

Any one of several colors of ink (for example, yellow, magenta, cyan and black) is jetted from one recording head 40. Basically, ink droplets are jetted from the recording heads 40 with different colors, respectively. However, ink may be jetted from more than one recording head 40 with the same color. Each of the jet openings is connected to ink tanks (not shown) for supplying ink with color to be jetted. The ink supplied from the ink tank is filled in nozzles (not shown) and jetted on the recording medium 24 according to need.

The UV irradiation devices 41 are disposed on downstream side of the recording heads 40, respectively, in the sub scanning direction in which the recording medium 24 is carried from the driven roller 30 to the driven roller 31. That is, the UV irradiation devices 41 and the recording heads 40 are alternately disposed in the carrying direction of the recording medium 24. The UV irradiation devices 41 are also disposed to be adapted to extend in the width direction of the recording medium 24 same as the recording heads 40. The UV irradiation devices 41 irradiate the recording medium 24 which is carried from the driven roller 30 to the driven roller 31 with UV-rays.

In the embodiment, the recording medium 24 is scanned in the sub scanning direction relative to the recording heads 40, enabling the recording heads 40 and the recording medium 24 to scan relatively each other.

Figure 7:
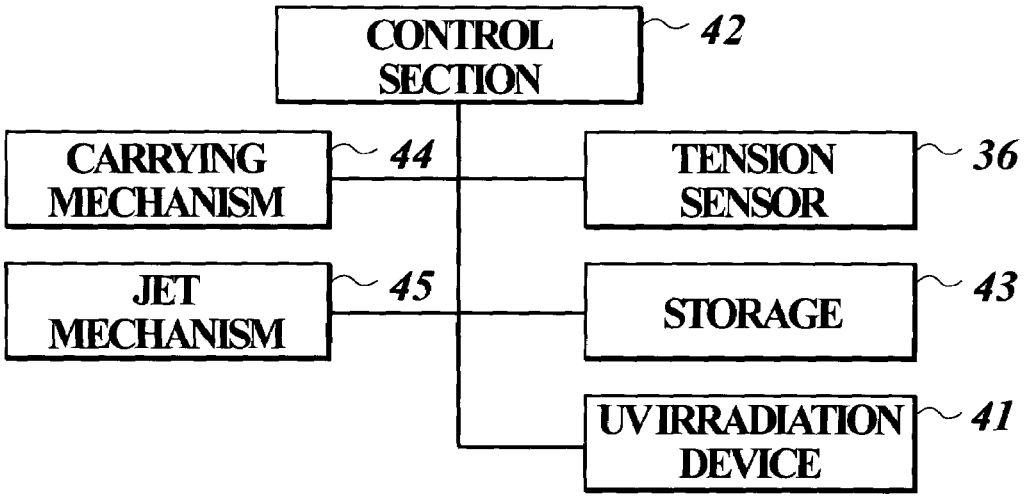
FIG. 7 is a block diagram showing a structure of the ink jet printer shown in FIG. 6.

The ink jet printer 23 comprises a control section 42 and a storage 43 as shown in FIG. 7. The control section 42 is connected to a carrying mechanism 44 for carrying the recording medium 24 in the sub scanning direction, a jet mechanism 45 for jetting ink from the recording head 40 and the UV irradiation device 41, and emits control signals to each of them to control an image recording processing of the ink jet printer 23. The tension sensor 36 transmits tension which acts on the recording medium 24 to the control section 42 as a detection signal.

The storage 43 stores a reference value of the tension on the recording medium 24 to be carried. The control section 42 compares the detected tension on the recording medium 24 and the reference value stored in the storage 43. When the detected tension differs from the reference value, the control section 42 judges that abnormality occurred in the ink jet printer 23. In this case, the control section 42 emits control signals to the carrying mechanism 44 and jet mechanism 45 to stop the movement of the recording head 40 and the carrying of the recording medium 24. Moreover, the control section 42 emits a control signal to the UV irradiation device 41 to stop the UV irradiation.

The UV curable ink is same as that described in the first embodiment.

An operation in the embodiment will be explained referring to FIG. 8.

Figure 8:
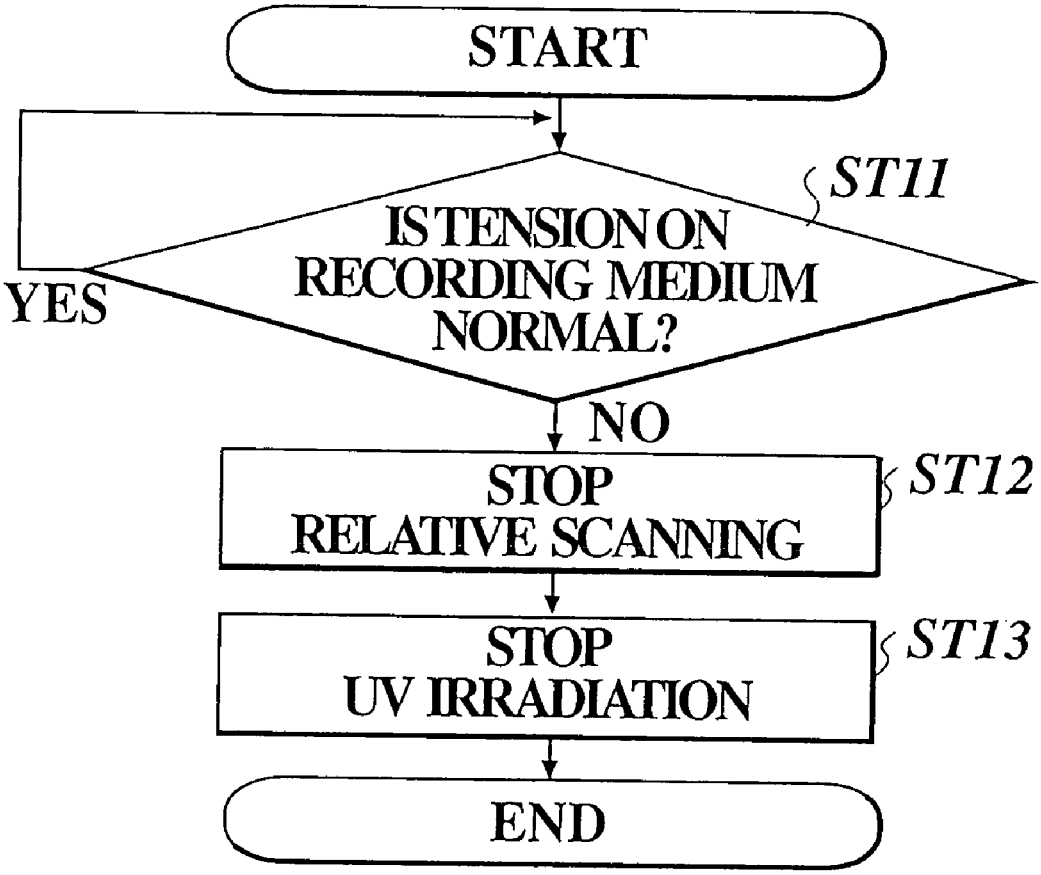
FIG. 8 is a flow chart showing a control performed by the ink jet printer shown in FIG. 6 when abnormality occurs.

FIG. 8 is a flow chart showing a control performed by the ink jet printer 23 when abnormality occurs.

The ink jet printer 23 drives a driving motor of the carrying mechanism 44 to rotate the winding roller 35 after receiving an image forming processing order. When the winding roller 35 starts rotating, the recording medium 24 which is wound around the feed roller 26 is withdrawn from the feed roller 26 and is sequentially carried from the driven roller 27 to the winding roller 35 while being hauled.

The recording head 40 jets ink on the recording medium 24 at a predetermined timing corresponding to the speed of carrying the recording medium 24. The UV irradiation device 41 irradiates the recording medium 24 on which ink is jetted with UV-rays to cure the jetted ink.

During the image recording processing, the winding roller 35 is rotated by the driving motor. The recording medium 24 is withdrawn from the feed roller 26 so as to pass through on the platen 37 at a regular speed, and the winding roller 35 continues to wind the recording medium 24 on which the image recording processing was performed.

The tension sensor 36 attached to the driven roller 31 detects tension on the recording medium 24 which is carried by the rotation of winding roller 35, and a detection signal to the control section 42.

The control section 42 compares the tension transmitted from the tension sensor 36 and the reference value stored in the storage 43. When these values are equal (Step ST11; YES), the control section 42 judges that the scanning is carried out normally. When the tension transmitted from the tension sensor 36 differs from the reference value stored in the storage 43 (Step ST11; NO), the control section 42 judges that abnormality occurred.

The control section 42 which judges that abnormality occurred in the ink jet printer 23 emits control signals to the jet mechanism 45 and the carrying mechanism 25 to stop the movement of the recording head 40 and the carrying of the recording medium 24 (Step ST12). The control section 42 also emits control signal to the UV irradiation device 41 to stop the UV irradiation (Step ST13).

Accordingly, in the embodiment, the tension sensor 36 detects the tension on the recording medium 24 to be carried. When the control section 42 judges that abnormality occurred in the ink jet printer 23, the control section 42 stops the movement of the recording head 40 and the carrying of the recording medium 24. Thus, even when jamming of the recording medium 24 or the like occurred in the ink jet printer 23, UV-rays are not radiated to the surface of the recording head 40. Therefore, the UV curable ink which attaches to the jet surface of the recording head 40 can be prevented from curing.

[Fourth Embodiment]

Figure 9:
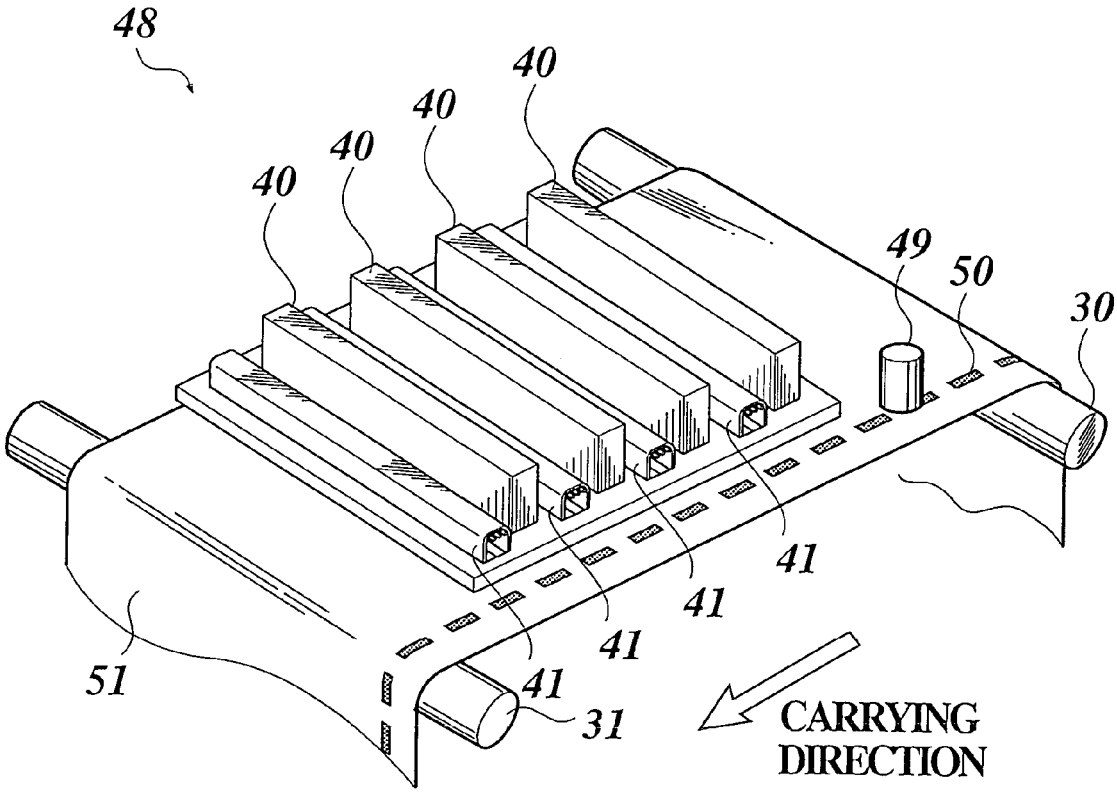
FIG. 9 is a side view showing another embodiment of the ink jet printer of line print type according to the present invention.

The fourth embodiment of the present invention will be explained referring to FIG. 9. In an ink jet printer 48 in the embodiment, a structure is same as that in the third embodiment except that a read sensor 49 is provided as the detection mechanism instead of the tension sensor 36. Only the structure which is different from the third embodiment will be explained below.

In the ink jet printer 48, a recording medium 51 on which marker 50 is printed at one end of the upper surface at regular intervals in a longer direction is used. A read sensor 49 for reading the marker 50 to generate a signal is provided above recording medium 51 corresponding to the position of marker 50. The read sensor 49 comprises a light emitting element and a light receiving element which are disposed on the same plane, and the light emitted from the light emitting element is reflected from the marker 50 to be detected by the light receiving element.

The markers may be formed by forming holes on one end of the upper surface of the recording medium at regular intervals in the longer direction. In this case, the read sensor comprises the light emitting element and the light receiving element which are disposed to oppose each other through the recording medium at the position corresponding to the marker of the recording medium. The light receiving element detects the light emitted from the light emitting element and transmits through the marker.

The read sensor 49 is connected to the control section 42 which calculates the actual carrying speed of the recording medium 51 on the basis of the signal is emitted from the read sensor 49.

The storage 43 stores the preset carrying speed of the recording medium 51 and the permissible error which is permitted between the preset carrying speed and the actual carrying speed. When the error between the actual carrying speed of the recording medium 51 calculated on the basis of the signal emitted from the read sensor 49 and the preset carrying speed exceeds the permissible error, the control section 42 stops the carrying of the recording medium 51 by the carrying mechanism 44, the ink jetting by the jet mechanism 45 and the UV irradiation by the UV irradiation device 41.

An operation in the embodiment will be explained. When recording an image, the read sensor 47 sequentially reads the marker 50 which is provided on recording medium 51 to be carried in the carrying direction, and emits signal to the control section 42. The control section 42 calculates the actual carrying speed of the recording medium 51 on the basis of the signal emitted from the read sensor 49 to judge that whether the error with respect to the preset carrying speed is within the range of the permissible error. When jamming or the like occurs, and the error between the actual carrying speed of the recording medium 51 calculated on the basis of the signal emitted from the read sensor 49 and the preset carrying speed exceeds the permissible error, the control section 42 stops the operations by the carrying mechanism 44, the jet mechanism 45 and the UV irradiation device 41. Thus, the image recording operation and the UV irradiation are stopped.

Accordingly, the UV irradiation is stopped when jamming of the recording medium 51 or the like occurred in the ink jet printer 48, so that the UV curable ink which attaches to the jet surface of the recording head 40 can be prevented from curing.

The entire disclosure of Japanese Patent Application No. Tokugan 2002-343548 which was filed on Nov. 27, 2002, and Japanese Patent Application No. Tokugan 2003-375638 which was filed on Nov. 5, 2003, including specification, claims, drawings and summary are incorporated herein by reference in its entirety.

What is claimed is:

1. An ink jet printer comprising:

a recording head for jetting an active energy ray curable ink on a recording medium, wherein the ink is jetted to the recording medium while carrying out a scanning the recording head and the recording medium relatively scanned;

an active energy ray irradiation device for irradiating the recording medium on which the ink was jetted with an active energy ray to cure the ink jetted;

a detection mechanism for detecting a scanning condition of at least one of the recording head and the recording medium; and a control section for stopping the active energy ray irradiation by the active energy ray irradiation device when the control section judges from a detected result by the detection mechanism that scanning the recording head and the recording medium relatively is not carried out normally.

2. The ink jet printer of claim 1, wherein the active energy ray irradiation device is positioned on a downstream side of a position recorded by the recording head in a direction of the scanning.

3. The ink jet printer of claim 1, wherein the control section stops the scanning when the control section judges from the detected result by the detection mechanism that the scanning is not carried out normally.

4. The ink jet printer of claim 1, further comprising a carriage for mounting the recording head, a driving motor for moving the carriage, and a carrying mechanism for carrying the recording medium, wherein the recording head is a serial print type, and the scanning is carried out by reciprocally moving the carriage in a direction perpendicular to a carrying direction of the recording medium.

5. The ink jet printer of claim 4, wherein a motor encoder for generating a pulse signal to detect a rotation amount of the driving motor is provided as the detection mechanism, and the control section judges that the scanning is not carried out normally when the motor encoder does not output a pulse signal normally.

6. The ink jet printer of claim 4, wherein a linear encoder for generating a pulse signal by being synchronized with a movement of the carriage is provided as the detection mechanism, and the control section judges that the scanning is not carried out normally when the linear encoder does not output a pulse signal normally.

7. The ink jet printer of claim 4, wherein the control section stops the scanning by emitting a control signal to the driving motor and the carrying mechanism when the control section judges that the scanning is not carried out normally.

8. The ink jet printer of claim 7, wherein the carriage is provided to be movable up and down relative to the recording medium, and the control section moves up the carriage and removes the carriage from a recording region after stopping the scanning.

9. The ink jet printer of claim 1, wherein the recording head is a line print type, and the scanning is carried out by carrying the recording medium relative to the recording head.

10. The ink jet printer of claim 9, wherein a read sensor for reading a marker attached to the recording medium to generate a signal is provided as the detection mechanism, and the control section judges that the scanning is not carried out normally when the read sensor does not output a signal normally.

11. The ink jet printer of claim 9, wherein a tension sensor for detecting a tension which acts on the recording medium to be carried is provided as the detection mechanism, and the control section judges that the scanning is not carried out normally when the tension sensor detects a tension which is not less than a predetermined value.

12. The ink jet printer of claim 1, wherein a light receiving sensor for detecting an active energy ray is provided as the detection mechanism on a surface of the recording head in which jet openings for jetting the ink are formed, and the control section judges that the scanning is not carried out normally when the light receiving sensor detects an active energy ray which is not less than a predetermined value.

13. The ink jet printer of claim 1, wherein the control section stops the active energy ray irradiation by emitting a control signal to the active energy ray irradiation device when the control section judges that the scanning is not carried out normally.

14. The ink jet printer of claim 1, wherein the active energy ray curable ink comprises an ultraviolet curable ink which contains a polymerizable composition.

15. The ink jet printer of claim 14, wherein the ultraviolet curable ink comprises a cationic polymerization ink.

16. The ink jet printer of claim 14, wherein the ultraviolet curable ink comprises a radical polymerization ink.

17. The ink jet printer of claim 1, wherein a plurality of recording heads are provided to jet same color of ink from more than one recording heads.

18. An ink jet recording method comprising the steps of:

jetting an active energy ray curable ink on a recording medium by a recording head while scanning the recording head and the recording medium relatively;

irradiating the recording medium on which the ink was jetted with an active energy ray by an active energy ray irradiation device to cure the ink;

detecting a scanning condition of at least one of the recording head and the recording medium;

judging from a detected result whether the scanning is carried out normally; and stopping the irradiation with an active energy ray by the active energy ray irradiation device when the scanning is judged not to be carried out normally.

19. The ink jet recording method of claim 18, wherein the active energy ray irradiation device is positioned on a downstream side of a position recorded by the recording head in a direction of the scanning.

20. The ink jet recording method of claim 18, further comprising a step of stopping the scanning when the scanning is judged not to be carried out normally.

* * * * *